US008037621B2

(12) United States Patent
Hooper

(10) Patent No.: US 8,037,621 B2
(45) Date of Patent: Oct. 18, 2011

(54) ARTICLE OF FOOTWEAR INCLUDING A WOVEN STRAP SYSTEM

(75) Inventor: Paul Hooper, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 1069 days.

(21) Appl. No.: 11/854,696

(22) Filed: Sep. 13, 2007

(65) Prior Publication Data

US 2009/0071041 A1 Mar. 19, 2009

(51) Int. Cl.
*A43B 7/06* (2006.01)
*A43B 3/12* (2006.01)
*A43C 11/00* (2006.01)

(52) U.S. Cl. ..... 36/3 A; 36/11.5; 36/50.1; 36/102

(58) Field of Classification Search ..... 36/11.5, 36/45, 50.1, 3 A, 102
See application file for complete search history.

(56) References Cited

U.S. PATENT DOCUMENTS

| | | | | |
|---|---|---|---|---|
| D37,359 | S | 2/1905 | Borchardt | |
| 1,088,309 | A * | 2/1914 | Weidt | 36/11.5 |
| 1,773,127 | A | 8/1930 | Auster | |
| 2,069,381 | A | 2/1937 | Morgan | |
| 2,112,884 | A * | 4/1938 | Gillette et al. | 36/11.5 |
| 2,161,472 | A * | 6/1939 | Hurwit | 36/3 R |
| 2,185,762 | A | 1/1940 | Cox | |
| 2,193,943 | A | 3/1940 | Shea | |
| 2,468,573 | A * | 4/1949 | Rimer | 36/11.5 |
| 2,526,940 | A * | 10/1950 | Fello | 36/11.5 |
| 2,596,188 | A | 5/1952 | Webb | |
| 2,773,317 | A * | 12/1956 | Helle | 36/11.5 |
| 2,862,311 | A * | 12/1958 | Ellis | 36/11.5 |
| 3,323,233 | A * | 6/1967 | Scholl | 36/11.5 |
| 4,535,554 | A | 8/1985 | De Obaldia B. | |
| D300,781 | S | 4/1989 | Finn | |
| D305,176 | S | 12/1989 | Campbell | |
| 5,483,757 | A | 1/1996 | Frykberg | |
| 5,555,584 | A | 9/1996 | Moore, III et al. | |
| 5,689,901 | A | 11/1997 | Bell et al. | |
| 5,836,090 | A * | 11/1998 | Smith | 36/7.6 |
| 6,237,249 | B1 | 5/2001 | Aguerre | |
| D467,723 | S | 12/2002 | Gerber et al. | |
| 6,490,814 | B2 * | 12/2002 | Matis | 36/11.5 |
| 6,493,965 | B1 | 12/2002 | Bathum | |
| 6,543,157 | B2 * | 4/2003 | Pan | 36/11.5 |
| 6,637,130 | B2 * | 10/2003 | Urie et al. | 36/11.5 |
| D496,523 | S | 9/2004 | Fuerst | |
| D497,244 | S | 10/2004 | Sedlbauer | |
| D498,575 | S | 11/2004 | Fuerst | |
| 2003/0182820 | A1 | 10/2003 | Fuerst et al. | |

FOREIGN PATENT DOCUMENTS

| | | |
|---|---|---|
| FR | 2484215 | 12/1981 |

* cited by examiner

*Primary Examiner* — Jila Mohandesi
*Assistant Examiner* — Sharon M Prange
(74) *Attorney, Agent, or Firm* — Plumsea Law Group, LLC

(57) ABSTRACT

An article of footwear including a woven strap system is disclosed. The woven strap system preferably wraps along the entirety of the outsole, including a bottom side and an outer periphery. The article of footwear also includes a midsole that rests inside the woven strap system, just above the outsole.

21 Claims, 10 Drawing Sheets

ARTICLE OF FOOTWEAR INCLUDING A WOVEN STRAP SYSTEM

BACKGROUND OF THE INVENTION

1. Field of the Invention

The present invention relates generally to footwear, and in particular the present invention relates to articles of footwear that include a woven strap system disposed along the entirety of the article of footwear.

2. Description of Related Art

Articles of footwear generally include some kind of provision that secures the outsole to a wearer's foot. Often, an upper is provided that encloses the wearer's foot and secures the outsole beneath the foot. In articles of footwear that are configured to be open, such as sandals, the article of footwear may include only a partial upper. In some cases, the upper may comprise solid portions as well as woven portions. These woven portions may be constructed of overlapping strips of material. Often, the woven portions provide some ventilation for the article of footwear.

Woven shoes have been previously proposed. Hurwit (U.S. Pat. No. 2,161,472) teaches an oxford shoe in which a substantial connection is established between the upper and the insole, and presenting lacing of a character to form a weave of closely associated strands connecting the upper and the sole. In particular, the weave consists of strips of preferably leather material. A drawback to this design is that the strips woven through the shoe may not be used to adjustably tighten the article of footwear to a wearer's foot.

A second type of woven shoe, including strips woven along the entirety of the shoe, is taught by Finn (U.S. Pat. No. D. 300,781). However, Finn's design does not incorporate any type of lacing system or adjustable straps. Therefore, like the design of Hurwit, the article of footwear taught by Finn may not be adjustably tightened to a wearer's foot.

Generally, woven shoes are designed for casual or light walking. Woven shoes are often not suitable for extensive walking or hiking. In contrast, some types of sandals including woven straps have been configured to accommodate athletic endeavors such as hiking.

Bathum (U.S. Pat. No. 6,493,965) teaches a sandal including a front strap and a rear strap that are interlocked by means of a weave connection. This design may further include a pair of opposing lateral straps as well as an ankle strap. These straps may be individually adjusted to tighten the sandal to the wearer's foot. Additionally, each strap is coupled to a foot bed configured to receive the wearer's foot.

While the related art teaches various articles of footwear that are configured to be open, such as woven shoes and sandals, there are many shortcomings. The types of footwear discussed here lack a provision for tightly securing the entirety of the shoe, including the outsole, to a wearer's foot. Specifically, the prior art lacks provisions for pulling the outer edges of the outsole close to the wearer's foot. Including such provisions may increase the stability of the article of footwear during activities such as hiking. There is a need in the art for an article of footwear including a provision for wrapping the entirety of the outsole about a wearer's foot, including the outer edges of the outsole.

SUMMARY OF THE INVENTION

The invention discloses an article of footwear including a woven strap system. In one aspect, the invention provides an article of footwear, comprising: an outsole including an outer side disposed opposite a wearer's foot; the outsole being associated with at least one strap; and where a portion of the strap is disposed along the outer side.

In another aspect, the outsole is composed of a water proof material.

In another aspect, the strap is composed of a water proof material.

In another aspect, the outsole may be adjustably tightened to the wearer's foot using the strap.

In another aspect, the outsole is associated with a woven strap system including multiple straps disposed along the outer side of the outsole.

In another aspect, the outsole includes at least one slot disposed along the outer side.

In another aspect, the invention provides an article of footwear, comprising: an outsole including an outer periphery; the outsole being associated with at least one strap; and where a portion of the strap is disposed along the outer periphery of the outsole.

In another aspect, the outsole is composed of a water proof material.

In another aspect, the strap is composed of a water proof material.

In another aspect, the outsole includes at least one recess disposed along the outer periphery.

In another aspect, the recess is associated with the strap.

In another aspect, the outsole is associated with a midsole.

In another aspect, the outsole is associated with a woven strap system including multiple straps disposed along the outer side of the outsole.

In another aspect, the invention provides an article of footwear, comprising: an outsole associated with a midsole and at least one strap; the midsole including an outer periphery; and where the outer periphery of the midsole includes at least one recess configured to receive a portion of the strap.

In another aspect, the outsole is composed of a water proof material.

In another aspect, the midsole is composed of a water proof material.

In another aspect, the midsole is configured to move with respect to the outsole.

In another aspect, the strap is associated with a lacing system.

In another aspect, the outsole is associated with a partial upper.

In another aspect, the lacing system adjustably tightens the midsole and the outsole to a wearer's foot.

In another aspect, the invention provides an article of footwear, comprising: an outsole associated with a woven strap system; the woven strap system including at least one strap; a midsole associated with the outsole and the woven strap system; and where a portion of the midsole protrudes outward of the woven strap system.

In another aspect, the midsole includes at least one aperture.

In another aspect, the midsole is composed of a water proof material.

In another aspect, the strap is composed of a water proof material.

In another aspect, the outsole is composed of a water proof material.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
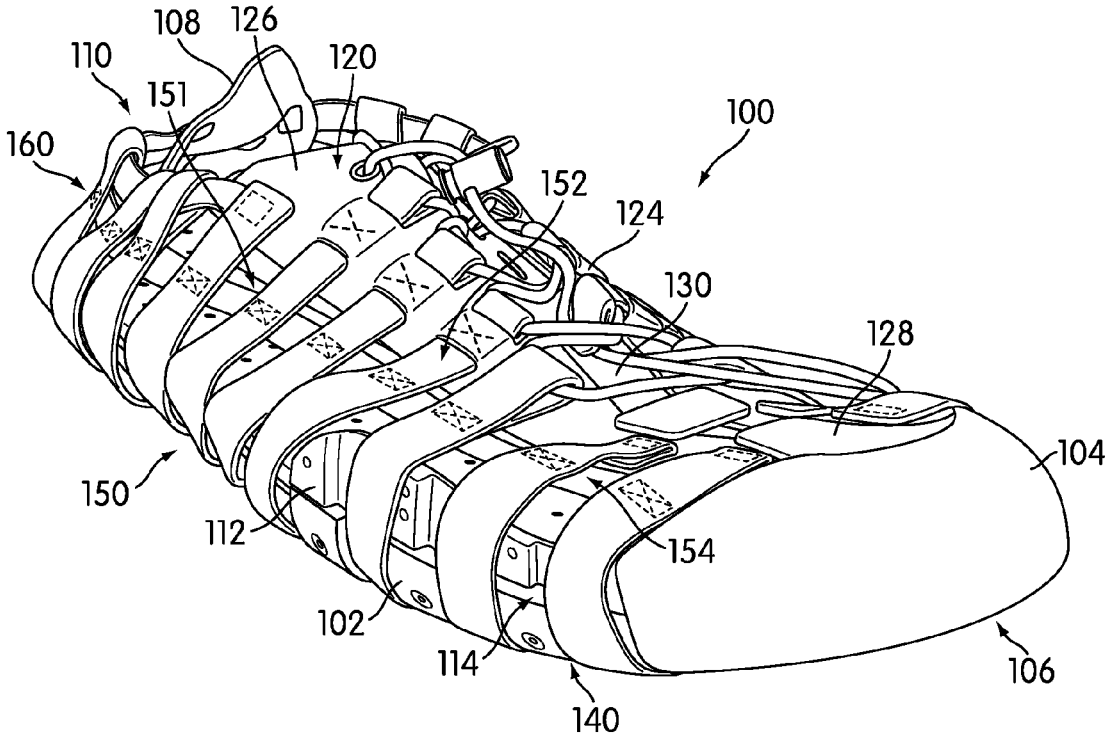
FIG. 1 is an isometric view of a preferred embodiment of an article of footwear.

FIG. 1 is a preferred embodiment of an article of footwear 100 in the form of a water footwear. For clarity, the following detailed description discusses a preferred embodiment, however this description may also be applied to various other types of footwear. Examples of such footwear include, but are not limited to, athletic shoes, sandals, cycling shoes, dance shoes, slippers, or any other kind of footwear.

Article of footwear 100 preferably includes outsole 102. Preferably, outsole 102 is constructed of a flexible and durable material. In some embodiments, outsole 102 may be constructed of rubber. In other embodiments, outsole 102 may be constructed of a synthetic material. In a preferred embodiment, outsole 102 may be constructed of a water proof material.

Preferably, outsole 102 may include provisions for protecting a wearer's toes and heel. In a preferred embodiment, outsole 102 includes toe member 104 disposed along forward side 106 of article of footwear 100. Toe member 104 is preferably a continuous extension of outsole 102. Preferably, toe member 104 may be configured to receive a wearer's toes. Toe member 104 may protect a wearer's toes during the use of article of footwear 100, as it is preferably made of a durable material. In a preferred embodiment, toe member 104 may be constructed from the same material as outsole 102.

Outsole 102 also preferably includes heel member 108 disposed along rear side 110 of article of footwear 100. Heel member 108 is preferably a continuous extension of outsole 102. Preferably, heel member 108 may be configured to engage a wearer's heel. In some embodiments, heel member 108 may protect a wearer's heel during use of article of footwear 100, as it is preferably made of a durable material. In a preferred embodiment, heel member 108 may be constructed from the same material as outsole 102.

Often, an article of footwear may include provisions for supplying support and comfort to a wearer's foot. In some cases, an article of footwear may include a midsole and/or an insole. In a preferred embodiment, article of footwear 100 may include midsole 112. Midsole 112 is preferably associated with outsole 102. In particular, midsole 112 is preferably disposed along a first side 114 of outsole 102. In a preferred embodiment, midsole 112 may be disposed adjacent to a wearer's foot, once it has been inserted into article of footwear 100.

Some articles of footwear may include provisions for securing an outsole to a wearer's foot. Usually, an upper is provided to enclose the wearer's foot, the upper being itself attached to the outsole. In some cases, an article of footwear may include only a partial upper. The term partial upper, as used here, indicates that some or substantially all of the medial and lateral walls of the upper are missing. Furthermore, there is no portion of the partial upper associated with the heel region of the article of footwear. A partial upper may be used in order to increase ventilation as well as to decrease the amount of time it takes to dry the article of footwear.

Article of footwear 100 preferably includes partial upper 120. In a preferred embodiment, partial upper 120 includes medial upper portion 124 and lateral upper portion 126. Medial upper portion 124 and lateral upper portion 126 are preferably disposed along the top of article of footwear 100. In particular, once a wearer's foot has been inserted into article of footwear 100, medial upper portion 124 and lateral upper portion 126 are preferably disposed adjacent to the instep portion of the wearer's foot.

Preferably, partial upper 120 may include an additional portion to provide adjustable support to the instep portion of a wearer's foot. In some cases, this additional portion may provide an adjustable opening between upper portions 124, 126 and the wearer's foot. In some embodiments, partial upper 120 may include tongue 130. Tongue 130 is preferably disposed between medial upper portion 124 and lateral upper portion 126. Like medial upper portion 124 and lateral upper portion 126, tongue 130 is preferably disposed adjacent to the instep portion of the wearer's foot during use of article of footwear 100.

In some embodiments, medial upper portion 124 and lateral upper portion 126 may not extend all the way to toe member 104. Instead, partial upper 120 may include a provision to connect medial upper portion 124 and lateral upper portion 126 to toe member 104. In a preferred embodiment, partial upper 120 may include forward upper portion 128. Forward upper portion 128 is preferably disposed adjacent to toe member 104. In a preferred embodiment, forward upper portion 128 is attached directly to toe member 104. Additionally, forward upper portion 128 is preferably attached directly to medial upper portion 124 and lateral upper portion 126. In other words, medial upper portion 124 and lateral upper portion 126 may be connected to outsole 102 via forward upper portion 128.

Generally, partial upper 120 may be constructed of any material. Typically, uppers are constructed from leather, fabrics or synthetic materials. Partial upper 120 may be constructed from any of these materials, or any other material. In addition, partial upper 120 may include other portions apart from medial upper portion 124, lateral upper portion 126, forward upper portion 128 and tongue 130.

Preferably, article of footwear 100 includes provisions for securing outsole 102 and partial upper 120 to a wearer's foot. In some embodiments, this provision may include a small surface area. A small surface area allows article of footwear 100 to dry quickly. Likewise, the provision may include large gaps to increase ventilation, which may also facilitate drying. This may be a useful feature if article of footwear 100 is to be used as a water footwear.

In a preferred embodiment, article of footwear 100 includes woven strap system 150. Preferably, woven strap system 150 includes a smaller surface area than conventional strap systems or full uppers. Woven strap system 150 also preferably includes gaps 151 between the straps comprising woven strap system 150. As with traditional woven designs, woven strap system 150 preferably provides an effective means of securing outsole 102 and partial upper 120 to a wearer's foot.

Woven strap system 150 preferably includes first strap set 152 and second strap set 154. In some embodiments, first strap set 152 may be associated with second strap set 154. In a preferred embodiment, first strap set 152 may be attached to second strap set 154. In particular, first strap set 152 is preferably attached to second strap set 154 in a manner such that each member of first strap set 152 is perpendicular to the members of second strap set 154.

In a preferred embodiment, first strap set 152 comprises multiple straps that wrap around article of footwear 100 circumferentially, from medial upper portion 124, to lateral upper portion 126. In particular, first strap set 152 may be disposed around outsole 102. Preferably, second strap set 154 wraps around article of footwear 100 in a direction perpendicular to the orientation of first strap set 152. In other words, second strap set 154 preferably comprises multiple straps that wrap around article of footwear 100 from toe member 104 to heel member 110 along a perimeter 160 coincident with outer periphery 140 of outsole 102.

Generally, woven strap system 150 may include any number of straps. In some embodiments, the number of straps comprising first strap set 152 will be greater than the number of straps comprising second strap set 154. In a preferred embodiment, first strap set 152 comprises 10 straps. In a preferred embodiment, second strap set 154 comprises 2 straps.

In some embodiments, woven strap system 150 may be constructed of any durable and flexible material. Examples of some materials include leather, fabric, and synthetic materials. Woven strap system 150 may be constructed of any other material as well. In a preferred embodiment, woven strap system 150 is constructed of a water proof material.

Figure 2:
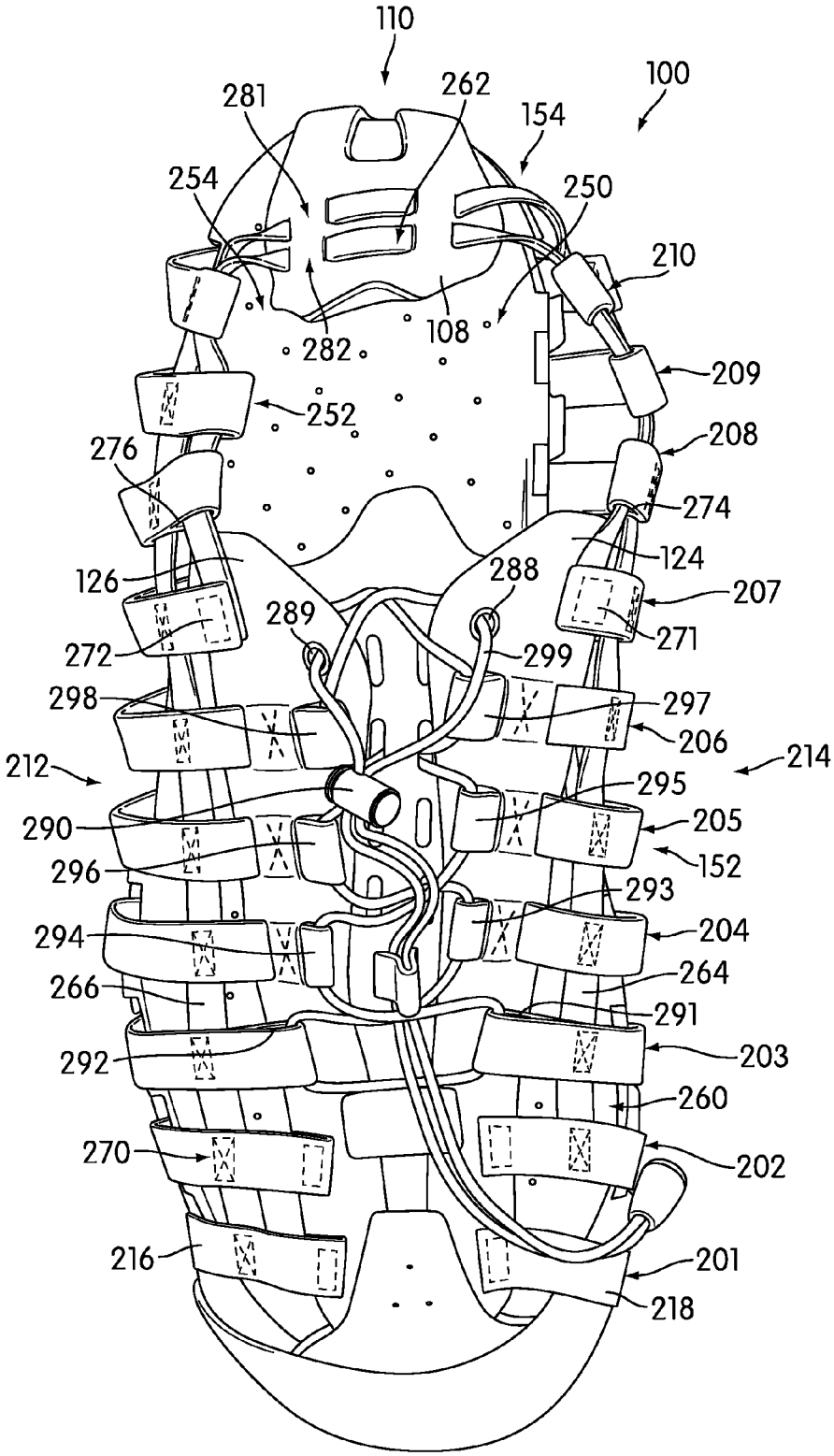
FIG. 2 is a plan view of a preferred embodiment of an article of footwear.

Referring to FIG. 2, first strap set 152 preferably includes first strap 201. First strap 201 preferably includes a first portion 216 disposed along lateral side 212 of article of footwear 100. First strap 201 also preferably includes a second portion 218 disposed along medial side 214 of article of footwear 100. In some embodiments, first portion 216 of first strap 201 may be associated with lateral upper portion 126. Second portion 218 of first strap 201 may be associated with medial upper portion 124. In a preferred embodiment, first portion 216 and second portion 218 of first strap 201 are fixed to lateral upper portion 126 and medial upper portion 124, respectively.

Preferably, first strap set 152 may also include second strap 202, third strap 203, fourth strap 204, fifth strap 205, sixth strap 206, and seventh strap 207. In a manner similar to first strap 201, each of the straps 202-207 may include a first portion and a second portion. In particular, the first portion of each of the straps 202-207 may be associated with lateral upper portion 126. The second portion of each of the straps 202-207 may be associated with medial upper portion 124.

In a manner similar to first strap 201, the first and second portions of second strap 202, as well as straps 204-207 are preferably fixed directly to lateral and medial upper portions 126 and 124. Preferably, the first and second portions of third strap 203 are not fixed directly to lateral upper portion 126 and medial upper portion 124. Instead, the first and second portions of third strap 203 are preferably disposed just above lateral upper portion 126 and medial upper portion 124, respectively. In other words, the two ends of second strap 202 float freely above partial upper 120.

Additionally, first strap set 152 preferably includes eighth strap 208, ninth strap 209, and tenth strap 210. As with the previous straps 201-207, each of these straps 208-210 preferably include a first portion and a second portion. In some embodiments, the first portions of each of the straps 208-210 may be with associated lateral side 212 of article of footwear 100. Also, the second portion of each of the straps 208-210 may be associated with medial side 214 of article of footwear 100.

In some embodiments, eighth strap 208, ninth strap 209, and tenth strap 210 may not be associated with any portion of partial upper 120. Instead, the first and second portions of each of the straps 208-210, along with heel member 108, may be associated with entry hole 250 of article of footwear 100. In a preferred embodiment, strap ends 252 of the first and second portions of each of the straps 208-210 may be coincident with outer periphery 254 of entry hole 250.

As previously discussed, woven strap system 150 also preferably includes second strap set 154. In some embodiments, second strap set 154 may include long strap 260. Preferably, long strap 260 is disposed along lateral side 212, rear side 110, and medial side 214 of article of footwear 100. In particular, long strap 260 preferably includes first portion 264 and second portion 266. First portion 264 of long strap 260 is preferably disposed along medial side 214 of article of footwear 100. Second portion 266 of long strap 260 is preferably disposed along lateral side 216 of article of footwear 100.

Preferably, long strap 260 is associated with straps 201-210. In some embodiments, long strap 260 may be disposed against the first and second portions of straps 201-210. In a preferred embodiment, long strap 260 may be attached to the first and second portions of straps 202-210 at attachment regions 270. Preferably, second portion 266 of long strap 260 is also attached to first portion 216 of first strap 201. Preferably, first portion 264 of long strap 260 does not extend to second portion 218 of first strap 201.

Second strap set 154 may also include short strap 262. Short strap 262 is preferably disposed along rear side 110 of article of footwear. In some embodiments, short strap 262 may be associated with the first and second portions of straps 207-210. In a preferred embodiment, a first end 271 of short strap 262 is attached directly to seventh strap 207 along medial side 214 of article of footwear 100. Likewise, a second end 272 of short strap 262 is preferably attached directly to seventh strap 207 along lateral side 212 of article of footwear 100.

Preferably, eighth strap 208, ninth strap 209 and tenth strap 210 include provisions for receiving short strap 262. In some embodiments, straps 208-210 may include loops through which short strap 262 may be disposed. In a preferred embodiment, eighth strap 208 includes first loop 274 disposed along medial side 214 of article of footwear 100. Additionally, eighth strap 208 preferably includes second loop 276 disposed along lateral side 212 of article of footwear 100. First loop 274 and second loop 276 are preferably configured to receive short strap 262 in a manner that allows short strap 262 to slide with respect to eighth strap 208.

In a manner similar to eighth strap 208, ninth strap 209 and tenth strap 210 also preferably include a first and a second loop configured to receive short strap 262. In this manner, the movement of short strap 262 may be constrained by straps 208-210. Likewise, the movement of straps 208-210 may be constrained by the movement of short strap 262.

In a preferred embodiment, the first and second loops of straps 208-210 are constructed by folding over strap ends 252 of straps 208-210. However, in other embodiments, the first and second loops of straps 208-210 may comprise a separate material that has been attached to strap ends 252 of straps 208-210. Also, in some embodiments, strap ends 252 of straps 208-210 may be fixed directly to short strap 262.

Preferably, article of footwear 100 includes a provision for attaching heel member 108 of outsole 102 to other portions of article of footwear 100. In some embodiments, heel member 108 may be associated with long strap 260 and short strap 262. In some embodiments, heel member 108 may include slots configured to receive long strap 260 and short strap 262. In a preferred embodiment, heel member 108 may include first heel slot set 281 and second heel slots set 282. First heel slot set 281 is preferably configured to receive long strap 260. Likewise, second heel slot set 282 is preferably configured to receive short strap 262.

Preferably, article of footwear 100 includes a provision for tightening partial upper 120 and woven strap system 150 to a wearer's foot. In some embodiments, article of footwear may include lacing system 290 disposed along partial upper 120. Generally, a lacing system may include any system disposed along partial upper 120 that is configured to tighten partial upper 120 and woven strap system 150 to a wearer's foot. Some examples of lacing systems include, but are not restricted to, shoe laces, zippers, buttons, as well as other types of lacing systems.

In a preferred embodiment, lacing system 290 comprises laces 299 that are inserted through several straps and a set of holes in partial upper 120. Preferably, third strap 203 includes a first loop 291 and a second loop 292 through which laces 299 are inserted. Likewise, straps 204-206 preferably include loops 293-298 through which laces 299 are inserted. Also, partial upper 120 preferably includes first hole 288 and second hole 289 through which laces 299 are inserted.

Preferably, article of footwear 100 includes provisions for securing the entirety of outsole 102 to a wearer's foot. In general, such provisions may include straps that are disposed along the outer periphery of outsole 102 as well as the bottom of outsole 102. This configuration of straps allows the outsole to conform to a wearer's foot in a manner that may add stability during use of article of footwear 100.

Figure 3:
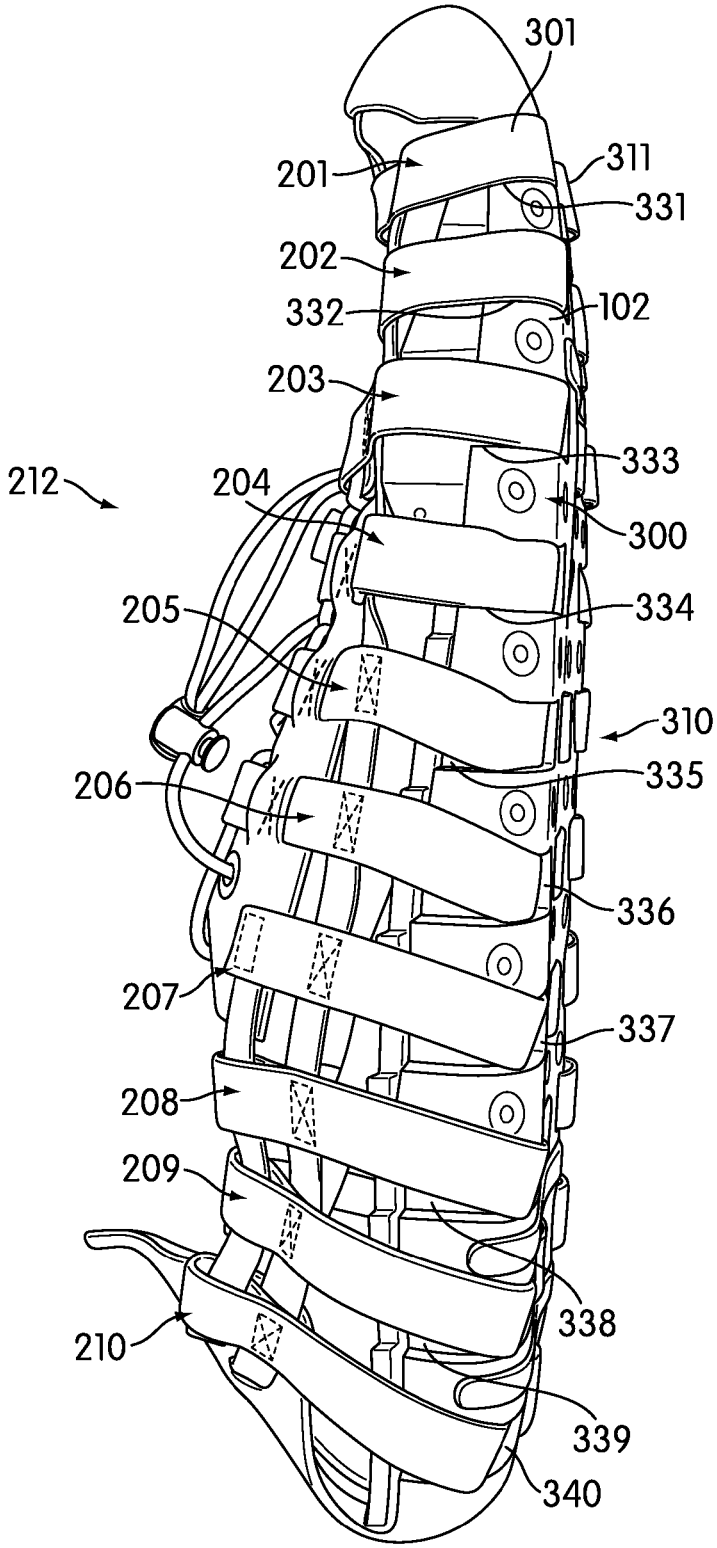
FIG. 3 is a side view of a preferred embodiment of an article of footwear.

Referring to FIG. 3, first strap 201 preferably continues from lateral side 212 of article of footwear 100 to outsole 102. Specifically, first strap 201 preferably includes a third portion 301 disposed along outer periphery 300 of outsole 102. Additionally, first strap 201 preferably includes a fourth portion 311 disposed along outer side 310 of outsole 102. In a preferred embodiment, first strap 201 includes a fifth portion disposed along a portion of outer periphery 300 on medial side 214 of article of footwear 100. This fifth portion preferably continues to second portion 218 of first strap 201. In other words, first strap 201 is preferably a continuous strap that wraps around article of footwear 100, including outsole 102.

In a manner similar to first strap 201, each of the remaining straps 202-210 preferably include a third portion disposed against outer periphery 300 of outsole 102. Similarly, straps 202-210 also preferably include a fourth portion disposed along outer side 310 of outsole 102 and a fifth portion disposed between the fourth portion and the second portion along outer periphery 300. In other words, straps 202-210 all preferably wrap around article of footwear 100, including outsole 102.

Generally, outsole 102 may include provisions to constrain the movement of straps 201-210 along outer periphery 300 and outer side 310. In some embodiments, these provisions may include recesses and slots configured to receive straps 201-210. In a preferred embodiment, outer periphery 300 may include recesses to minimize the tendency of straps 201-210 to slide along outer periphery 300. Additionally, outer side 310 may include slots configured to guide straps 201-210 along outer side 310 of outsole 102.

In a preferred embodiment, outsole 102 includes ten recesses disposed along outer periphery 300. For the purposes of clarity, a description of the eighth recess is given first, as this recess is clearly depicted in FIG. 3. Preferably, outsole 102 includes eighth recess 338 disposed along outer periphery 300 of outsole 102. In some embodiments, eighth recess 338 may be associated with third portion 301 of first strap 208. Preferably, eighth recess 338 may configured to receive third portion 308 of eighth strap 208. Eighth recess 338 may be constructed to have any depth. Eighth recess 338 is preferably constructed to have a depth that is approximately equal to the thickness of eighth strap 208.

In a manner similar to eighth recess 338, outer periphery 300 also preferably includes first recess 331, second recess 332, third recess 333, fourth recess 334, fifth recess 335, sixth recess 336, seventh recess 337, ninth recess 339, and tenth recess 340. In some embodiments, recesses 331-340 may be associated with straps 201-210. In a preferred embodiment, recesses 331-340 may be configured to receive straps 201-210. Each recess 331-340 is also preferably constructed of a depth that is approximately equal to the thickness of the associated strap 201-210. In other embodiments, each recess 331-340 may be constructed to have any desired depth.

Figure 4:
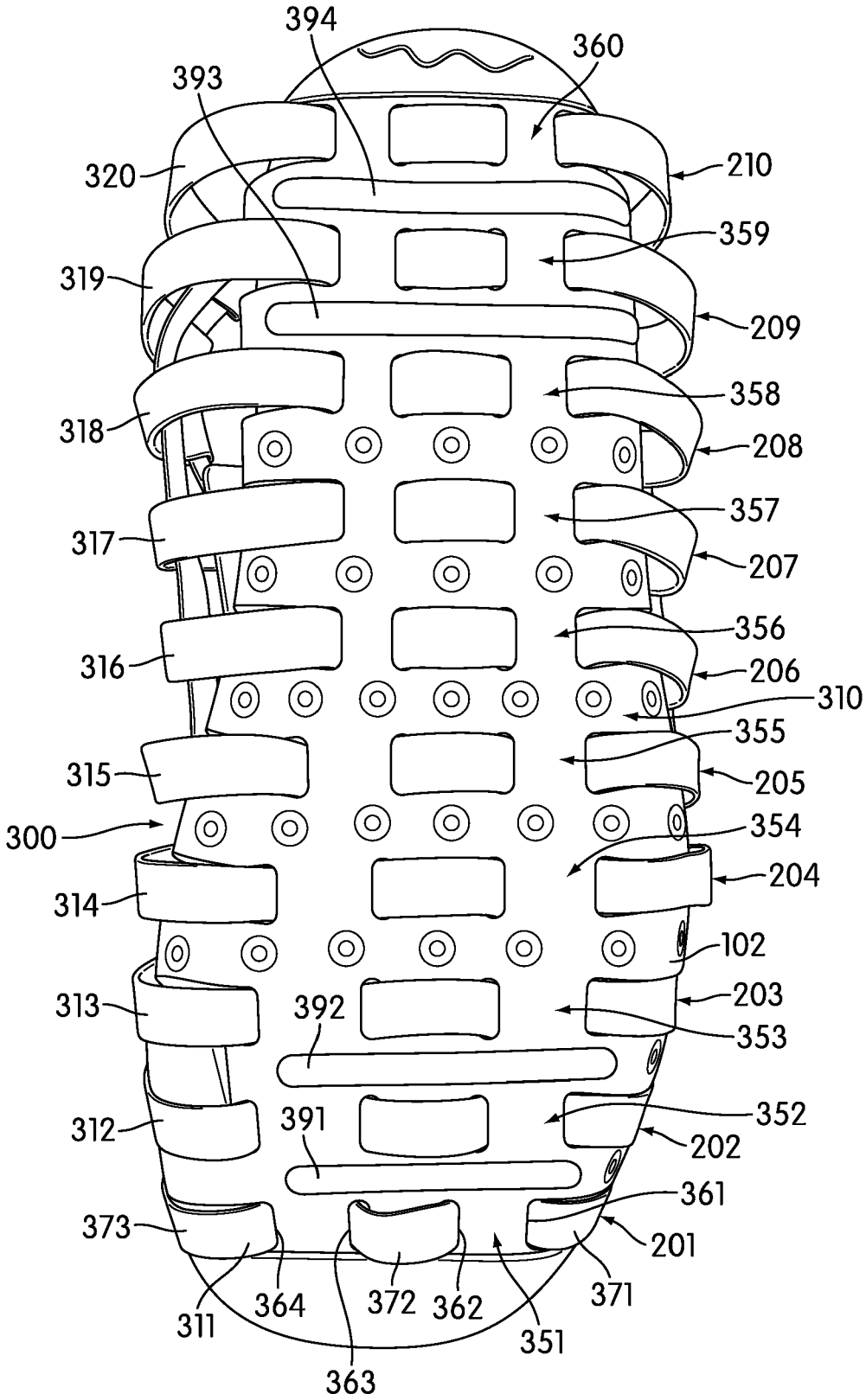
FIG. 4 is a plan view of a preferred embodiment of an outsole.

Referring to FIG. 4, outsole 102 preferably includes slots disposed along outer side 310. In a preferred embodiment, outer side 310 includes first slot set 351. In some embodiments, first slot set 351 may be associated with first strap 201. In a preferred embodiment, fourth portion 311 of first strap 201 may be disposed through slot set 351. In particular, fourth portion 311 of first strap 201 is preferably inserted through first slot 361, second slot 362, third slot 363, and fourth slot 364 in a direction that alternates. In other words, fourth portion 311 of first strap 201 preferably includes first outer region 371, disposed outer periphery 300 and first slot 361. In addition, fourth portion 311 preferably includes second outer region 372, disposed between second slot 362 and third slot 363. Finally, fourth portion 311 preferably includes third outer region 373, disposed between fourth slot 364 and outer periphery 300.

Preferably, outsole 102 also includes second slot set 352, third slot set 353, fourth slot set 354, fifth slot set 355, sixth slot set 356, seventh slot set 357, eighth slot set 358, ninth slot set 359, and tenth slot set 360. In some embodiments, slot sets 352-360 are preferably associated with fourth portions 312-320 of straps 202-210. In a preferred embodiment, each of the slot sets 352-360 may be configured to receive fourth portions 312-320 of straps 202-210 in a manner similar to the way in which first slot set 351 receives fourth portion 311 of first strap 201.

Generally, article of footwear 100 may include provisions for maintaining traction between outsole 102 and a surface. In some embodiments, these provisions may include tread elements. In a preferred embodiment, these provisions may include several tread bars disposed along outer side 310 of outsole 102.

In a preferred embodiment, outer side 310 of outsole 102 may include first tread bar 391, second tread bar 392, third tread bar 393, and fourth tread bar 394. First tread bar 391 may be constructed of a material that improves traction between outsole 102 and a surface. An example of such a material includes rubber. Tread bars 392-394 may be constructed of a similar material to first tread bar 391. In other embodiments, tread bars 391-394 may be constructed of other materials besides rubber.

Figure 5:
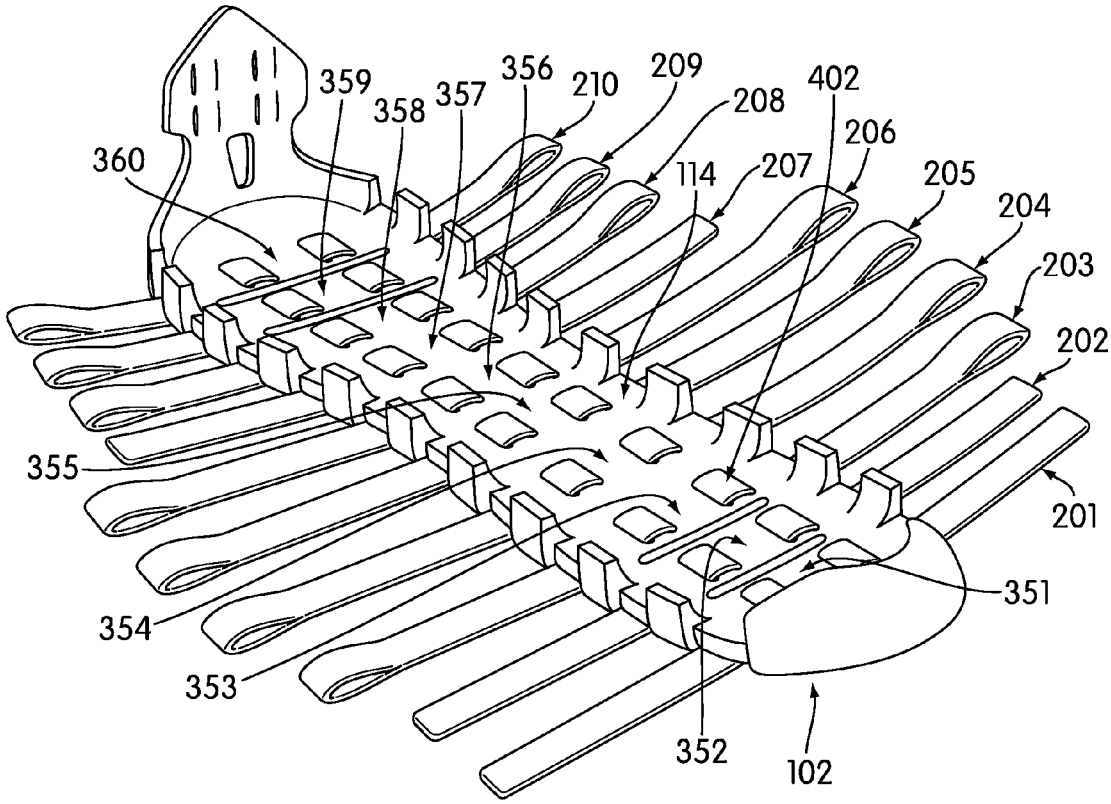
FIG. 5 is a isometric view of a preferred embodiment of an outsole with straps being inserted.
Figure 6:
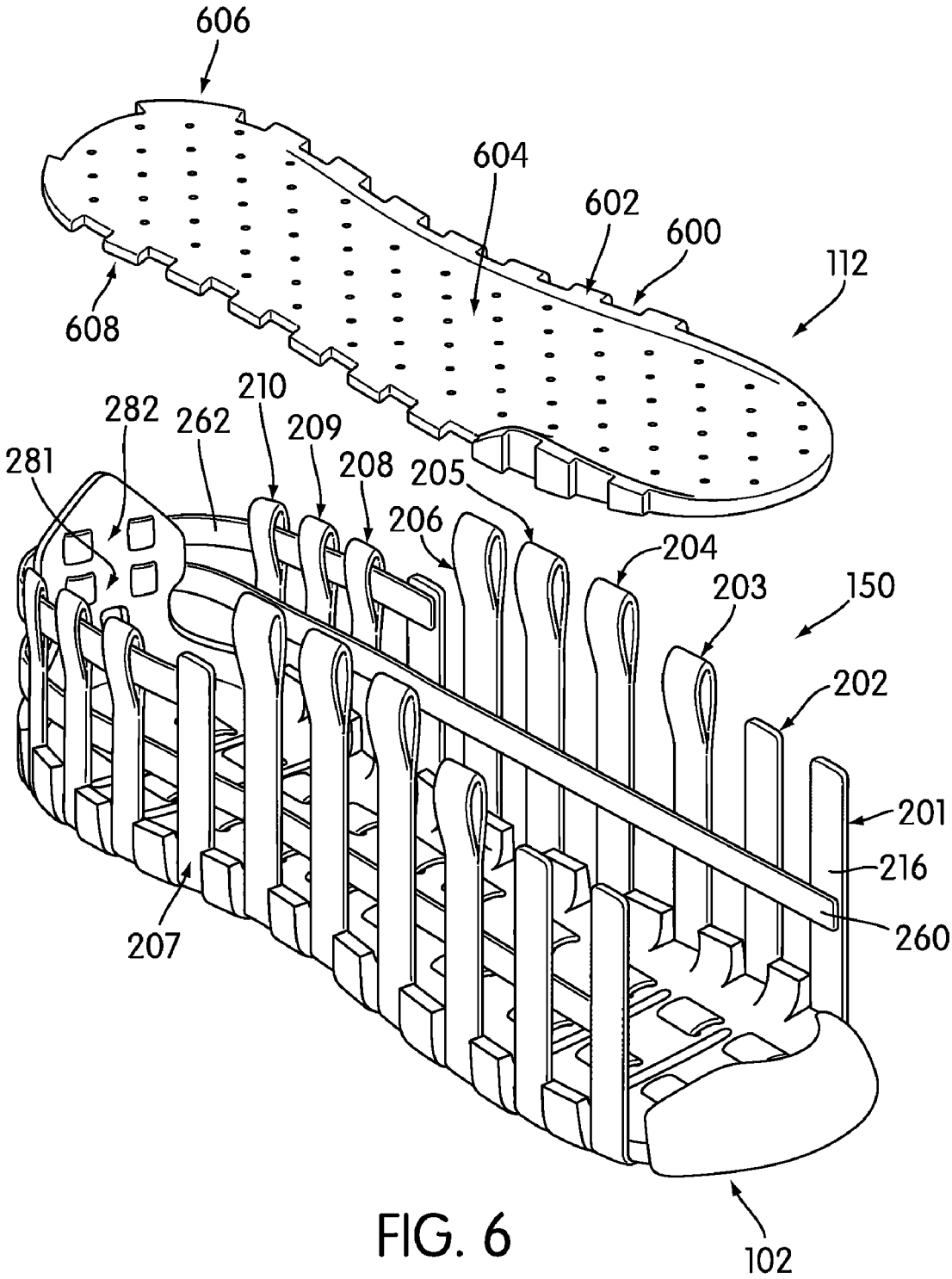
FIG. 6 is an isometric view of a preferred embodiment of an outsole and a midsole.
Figure 7:
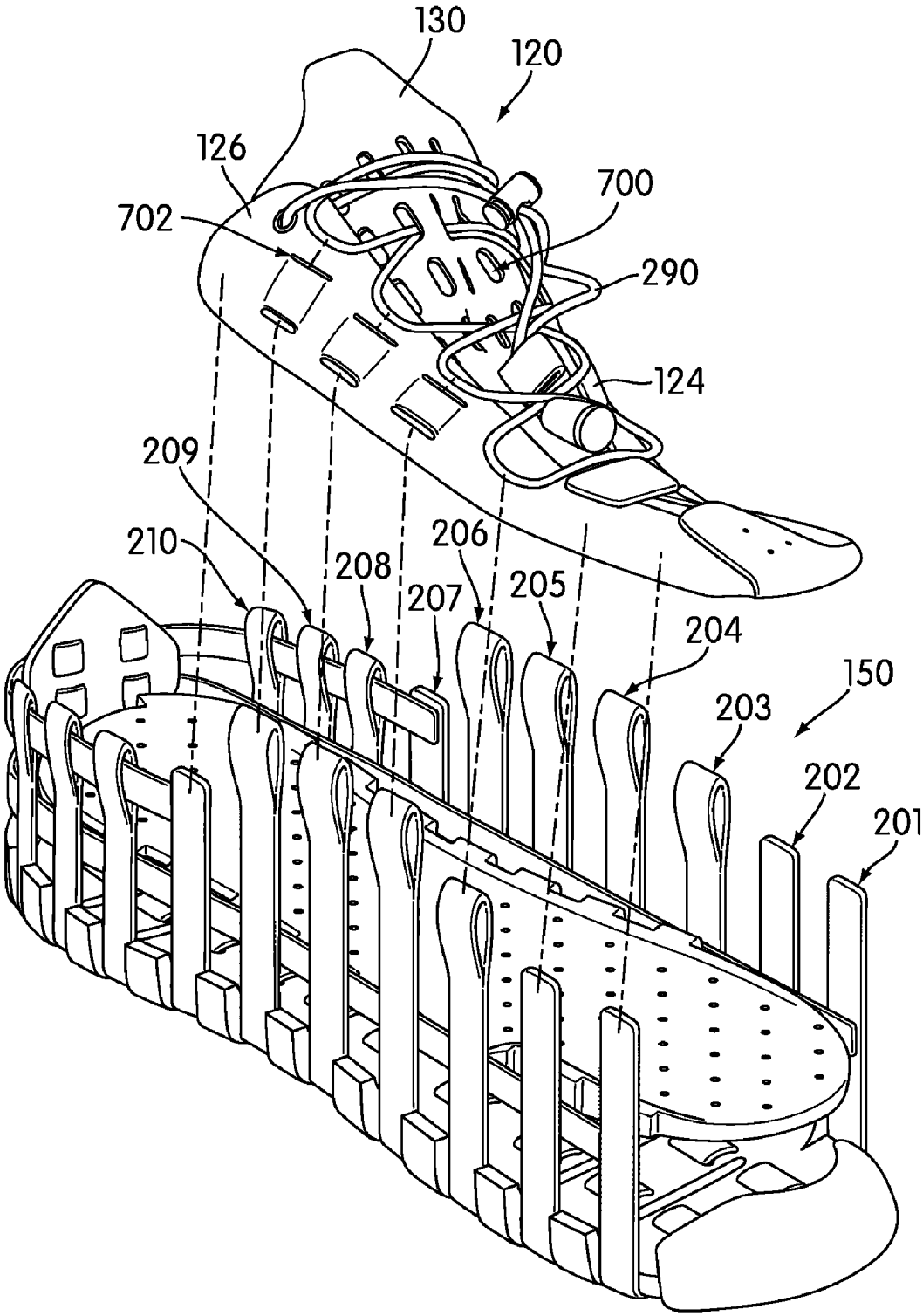
FIG. 7 is an isometric view of a preferred embodiment of a partial upper configured to attach to a woven strap system.

The general assembly of article of footwear 100 may be understood with reference to FIGS. 5-7. Referring to FIG. 4, straps 201-210 may be inserted through slot sets 351-360, respectively. This step is preferably done so that the straps are disposed along outsole 102 in the manner discussed previously. In particular, inner regions 402 of straps 201-210 will be visible along inner side 114 of outsole 102.

Returning to FIGS. 5-7, once first strap set 152 has been inserted through outsole 102, second strap set 154 may be associated with first strap set 152. Referring to FIG. 6, long strap 260 may be inserted through heel slot sets 281-282. Preferably, long strap 260 may also be attached to the first and second portions of straps 202-210. In a preferred embodiment, long strap 260 is stitched to straps 202-210. Also, long strap 260 is preferably attached to first portion 216 of first strap 201. In a preferred embodiment, long strap 260 is stitched to first portion 216 of first strap 201.

In a similar manner, short strap 262 may be inserted through heel slot sets 281-282 as well as the first and second loops of straps 208-210. In some embodiments, short strap 262 may be associated with the first and second portions of seventh strap 207. In a preferred embodiment, short strap 262 may be attached to the first and second portions of seventh strap 207. In particular, short strap 262 may be attached to seventh strap 207 by stitching.

Preferably, article of footwear 100 includes a provision for supporting a wearer's foot during use. As previously discussed, a midsole may be provided to add comfort and support. In a preferred embodiment, the midsole may not be attached directly to article of footwear 100. Instead, the midsole may be free to move with respect to the outsole and upper. This feature may allow the midsole to dry more readily as it will be loose within article of footwear 100.

Preferably, midsole 112 may be associated with outsole 102 once woven strap system 150 has been associated with outsole 102. Generally, the shape of midsole 112 may be varied. Preferably, the shape of the midsole conforms to the general shape of a wearer's foot. In this embodiment, midsole 112 has the same general shape as outsole 102.

Preferably, midsole 112 includes provisions to receive straps 201-210. In some embodiments, midsole 112 may include recesses for receiving straps 201-210. In a preferred embodiment, midsole 112 includes recessed regions 600. Recessed regions 600 are preferably configured to receive the first and second portions of straps 201-210. In some embodiments, recessed regions 600 are disposed along outer periphery 602 of midsole 112. Generally, the thicknesses of recessed regions 602 may be varied. In a preferred embodiment, recessed regions 600 may be deeper than the thicknesses of straps 201-210.

Midsole 112 may also include provisions for increasing the ventilation of article of footwear 100. In some embodiments, midsole 112 may include at least one aperture. In a preferred embodiment, midsole 112 may include apertures 604. Apertures 604 may facilitate the exchange of air and water between first side 606 and second side 608 of midsole 112.

Referring to FIG. 7, a final step in the assembly of article of footwear 100 may include associating partial upper 120 with woven strap system 150. Preferably, partial upper 120 may be associated with the first and second portions of straps 201-207. In a preferred embodiment, first strap 201, second strap 202 and straps 204-207 are attached to partial upper 120. Specifically, the first portions of straps 201-202 and straps 204-207 are preferably attached to medial upper portion 124. Likewise, the second portions of straps 201-202 and straps 204-207 are preferably attached to lateral upper portion 126. In a preferred embodiment, the first and second portions of third strap 203 are disposed above partial upper 120. Also, in preferred embodiments, straps 204-206 are associated with upper slots 702.

At this point, lacing system 290 may also be associated with article of footwear 100. In some embodiments, portions of lacing system 290 may be disposed through holes 700 in tongue 130. Once partial upper 120 has been attached to woven strap system 150, portions of lacing system 290 may be associated with straps 204-206.

Preferably, article of footwear 100 is configured to tighten around a wearer's foot once the foot has been inserted. Generally, the outsole and midsole may be disposed below the wearer's foot. Preferably, the woven strap system may include portions disposed along the lateral and medial side of a wearer's foot.

Figure 8:
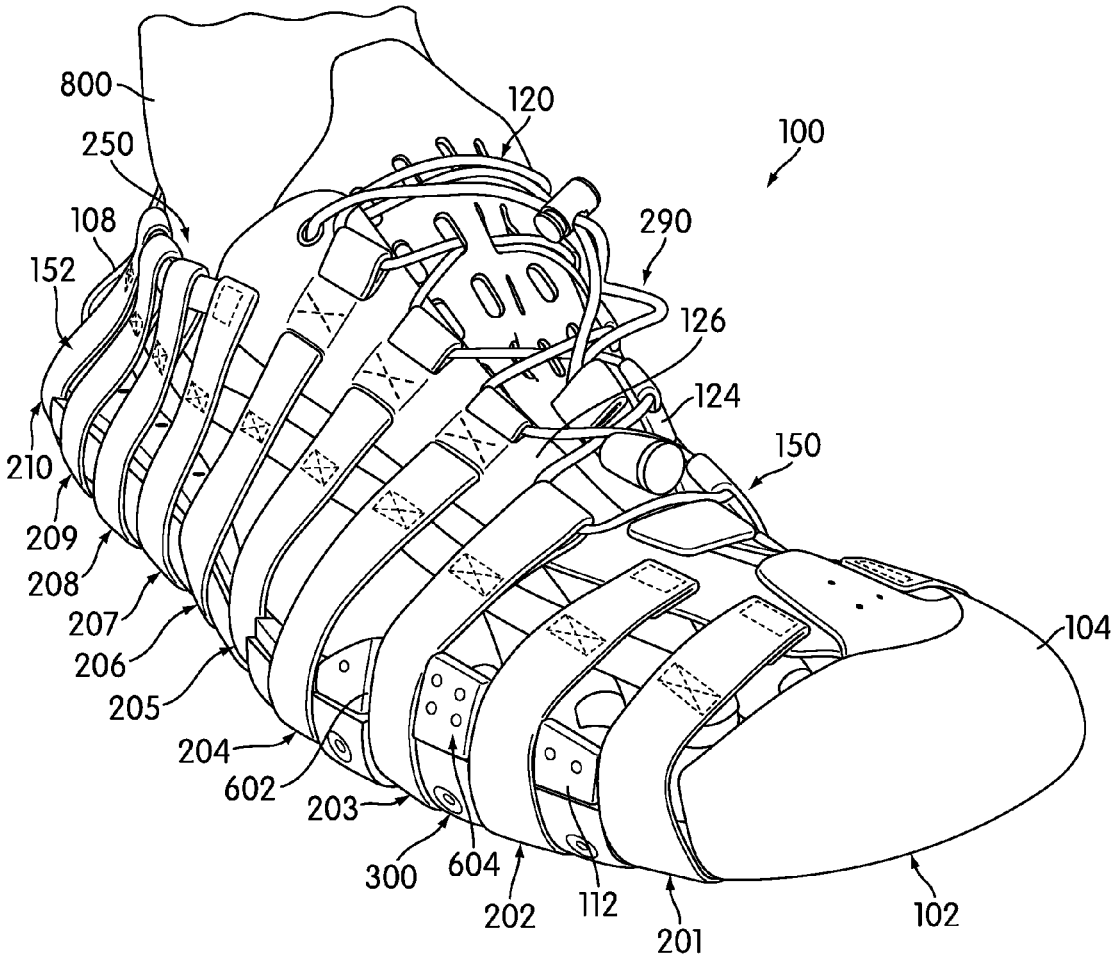
FIG. 8 is an isometric view of a preferred embodiment of an article of footwear with a wearer's foot inserted.

Referring to FIG. 8, a wearer's foot 800 may be inserted into article of footwear through entry hole 250. As previously discussed, partial upper 120 is preferably disposed against the instep of the wearer's foot. Heel member 108 is also preferably disposed against the wearer's heel. Likewise, toe member 104 is preferably disposed against the wearer's toes.

In a preferred embodiment, a wearer tightens article of footwear 100 using lacing system 290. As lacing system 290 is adjusted, medial upper portion 124 and lateral upper portion 126 of partial upper 120 are brought closer together. Since partial upper 120 is preferably attached to portions of woven strap system 150, the tightening of lacing system 290 preferably also tightens woven strap system 150 around the wearer's foot. In particular, the first portions of straps 201-210 are preferably tightened against the medial side of the wearer's foot. Likewise, the second portions of straps 201-210 are preferably tightened against the lateral side of the wearer's foot. Additionally, partial upper 120 is preferably tightened against the instep portion of the wearer's foot.

Recall that first strap set 152 may be loose prior to the insertion of a wearer's foot (see FIG. 1). Generally, midsole 112 may move independently of first strap set 152. In some cases, while article of footwear 100 is not in use, first strap set 152 may not be disposed against midsole 112. Specifically, there will be times when straps 201-210 are not disposed within recesses 602. Likewise, there will be times when midsole 112 will be disposed across outer periphery 300 of outsole 102. In this manner, midsole 112 may translate horizontally, independently of outsole 102, within a boundary defined by woven strap system 150.

However, once article of footwear 100 has been tightened around a wearer's foot, straps 201-210 are preferably disposed within recesses 602, as seen in FIG. 8. At this point, the movement of midsole 112 is restricted by first strap set 152. In this way, midsole 112 may be prevented from slipping with respect to outsole 102, which is also constrained to move with first strap set 152.

As the first and second portions of straps 201-210 are tightened, outsole 102 may also be pressed against wearer's foot 100. In a preferred embodiment, third and fifth portions of straps 201-210 apply tension to outer periphery 300 of outsole 102 in a manner that allows outsole 102 to compress slightly towards the medial and lateral sides of the wearer's foot. This may add stability over articles of footwear in which the outsole includes a portion that extends further beyond the straps used to tighten the outsole.

In the previous embodiment, midsole 112 was configured with recesses 600 that were configured to receive straps 201-210. In an alternative embodiment, an outer periphery of a midsole may be smooth, without recesses. This alternative configuration may reduce contact between the side of a wearer's foot and the straps of the article of footwear, decreasing the tendency for chaffing.

Figure 9:
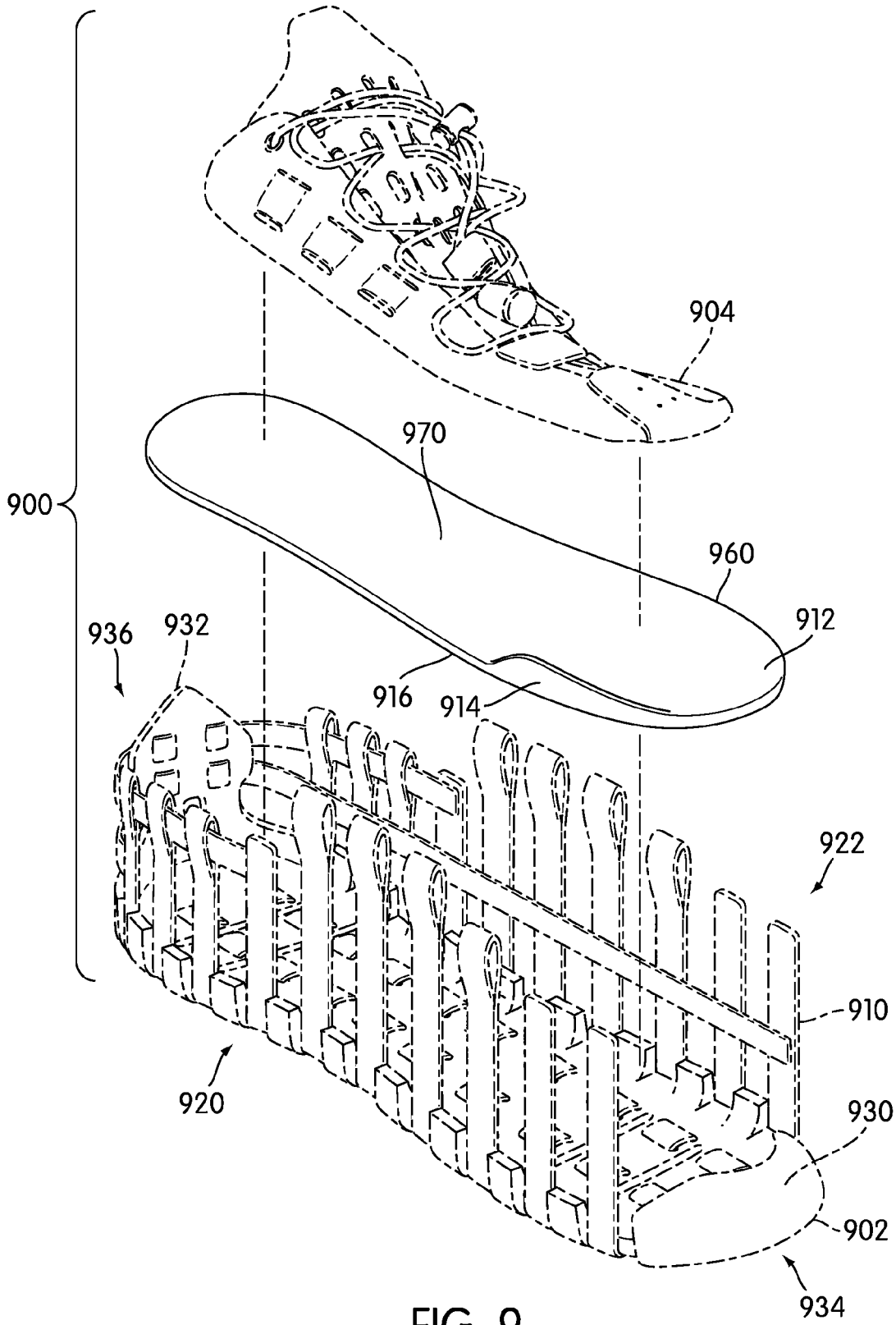
FIG. 9 is an exploded isometric view of a preferred embodiment of an article of footwear.

FIG. 9 is an exploded isometric view of a preferred embodiment of article of footwear 900, including outsole 902, partial upper 904 and midsole 912. Preferably, outsole 902 is further associated with straps 910 configured to wrap around a wearer's foot and attach at partial upper 904. For the purposes of clarity, outsole 902, straps 910 and partial upper 904 are shown here in phantom.

In this embodiment, midsole 912 includes outer periphery 960 and inner portion 970. Outer periphery 960 is preferably smooth. In other words, outer periphery 960 preferably does not include any gaps or recesses.

As article of footwear 900 is assembled, midsole 912 may sit loosely between outsole 902 and partial upper 904, as well as straps 910. Straps 910 may be configured to restrict the movement of midsole 912 towards lateral side 920 or medial side 922 of article of footwear 900. Additionally, toe member 930 and heel member 932 may be configured to restrict the motion of midsole 912 towards forward side 934 and rearward side 936 of article of footwear 900.

Using this preferred midsole arrangement, midsole 912 may be slightly displaced, but large displacements are restricted by straps 910, toe member 930 and heel member 932. Furthermore, because outer periphery 960 of midsole 912 is smooth, there is less chance for undesired contact between straps 910 and the side of a wearer's foot.

Midsole 912 may also include additional provisions for reducing undesired frictional contact between a wearer's toes and straps 910. In some embodiments, midsole 912 may include raised portion 914. Raised portion 914 is preferably disposed on lateral side 920 of midsole 912. In a preferred embodiment, raised portion 914 extends along forefoot portion 916 of midsole 912, and on lateral side 920.

Figure 10:
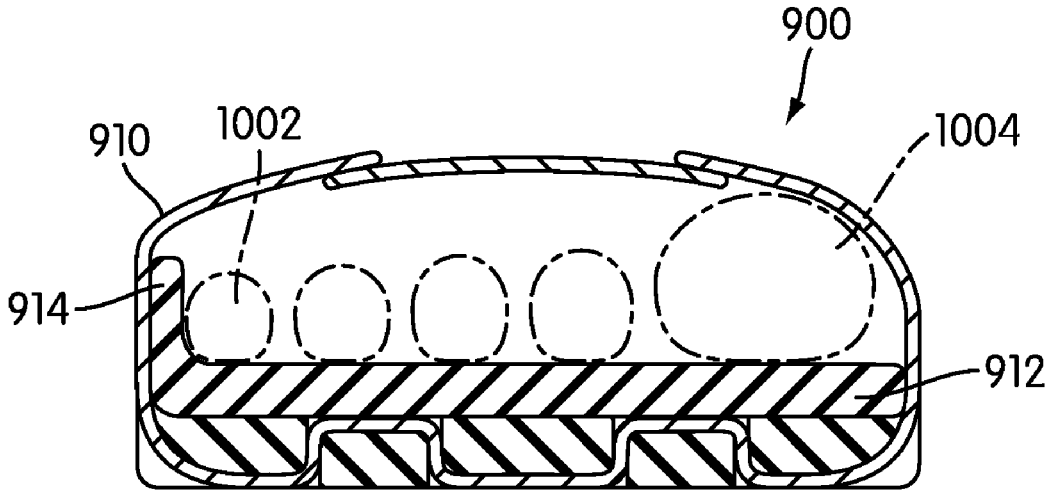
FIG. 10 is a front cross sectional view of a preferred embodiment of an article of footwear.

FIG. 10 is a cross sectional view of a preferred embodiment of an assembled view of article of footwear 900. In this embodiment, small toe 1002 is disposed against raised portion 914 of midsole 912. Using this configuration, small toe 1002 is protected from unwanted frictional contact with straps 910. Additionally, because midsole 912 includes a smooth outer periphery 960, straps 910 extend slightly outwards from large toe 1004. This preferred configuration may also reduce unwanted frictional contact between large toe 1004 and straps 910. Although only one strap comprising straps 910 may be seen in this cross sectional view, it should be understood that multiple straps comprising straps 910 may be disposed similarly to the strap shown here. In other words, this preferred configuration may reduce unwanted frictional contact between a wearer's foot and straps 910 along the entirety of article of footwear 900.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. An article of footwear, comprising:

an outsole including an outer side disposed along a bottom of the outsole and an outer periphery;

the outsole being associated with a woven strap system including multiple straps, the multiple straps including a first strap set disposed along the outer side of the outsole;

wherein a portion of the first strap set extends from the outer side and is disposed along the outer periphery of the outsole;

wherein the first strap set is associated with a lacing system; and wherein a second strap set is fixed upon the first strap set wherein the lacing system includes a lace configured to be inserted through one or more loops associated with the first strap set; and wherein the outsole may be adjustably tightened to a wearer's foot using the first strap set with the lacing system.

2. The article of footwear according to claim 1, wherein the outsole includes multiple recesses configured to receive the multiple straps.

3. The article of footwear according to claim 1, further comprising a midsole; and wherein the midsole includes at least one recess configured to receive a portion of one strap of the first strap set.

4. The article of footwear according to claim 1, wherein the outsole is composed of a water proof material.

5. The article of footwear according to claim 1, wherein the woven strap system is composed of a water proof material.

6. The article of footwear according to claim 1, wherein the outsole includes at least one recess disposed along the outer periphery.

7. The article of footwear according to claim 6, wherein the at least one recess is configured receive a portion of one strap of the first strap set.

8. The article of footwear according to claim 1, wherein the outsole is contiguous with a midsole.

9. The article of footwear according to claim 1, wherein the second strap set is approximately perpendicular to the first strap set.

10. An article of footwear, comprising:

an outsole contiguous with a midsole and at least one strap;

the midsole including an outer periphery; and wherein the outer periphery of the midsole includes at least one recess configured to receive a portion of the at least one strap;

wherein the outsole comprises at least one recess configured to receive a portion of the at least one strap;

wherein the at least one strap is woven across the width of the outsole through multiple apertures disposed through the outsole such that the at least one strap passes through the multiple apertures from a to of the outsole to a bottom of the outsole; and wherein a portion of the at least one strap passing through the multiple apertures is disposed along the bottom of the outsole.

11. The article of footwear according to claim 10, wherein the at least one strap is not woven through apertures of the midsole.

12. The article of footwear according to claim 10, wherein the midsole is composed of a water proof material.

13. The article of footwear according to claim 10, wherein the midsole is configured to move with respect the outsole.

14. The article of footwear according to claim 10, wherein the at least one strap is associated with a lacing system.

15. The article of footwear according to claim 14, wherein the lacing system adjustably tightens the midsole and the outsole to a wearer's foot.

16. The article of footwear according to claim 10, wherein the outsole is associated with a partial upper; wherein the at least one strap is woven through apertures of the partial upper.

17. An article of footwear, comprising:

an outsole associated with a woven strap system;

the woven strap system including multiple straps;

a midsole contiguous with the outsole and the woven strap system;

wherein a portion of the midsole protrudes outward of the woven strap system;

a partial upper, wherein the partial upper comprises a lacing system;

wherein the outsole comprises at least one recess configured to receive a portion of at least one strap of the multiple straps;

wherein the at least one strap is woven across the width of the outsole through multiple apertures disposed in the outsole such that the at least one strap passes through the multiple apertures from a top of the outsole to a bottom of the outsole; and wherein a portion of the at least one strap passing through the multiple apertures is disposed along the bottom of the outsole.

18. The article of footwear according to claim 17, wherein the midsole includes at least one aperture.

19. The article of footwear according to claim 17, wherein the midsole is composed of a water proof material.

20. The article of footwear according to claim 17, wherein the lacing system is attached to a portion of the multiple straps and the portion of the multiple straps is less than all of the multiple straps.

21. The article of footwear according to claim 17, wherein the outsole is composed of a water proof material.

* * * * *